US012247453B2

(12) United States Patent
Murphy

(10) Patent No.: US 12,247,453 B2
(45) Date of Patent: Mar. 11, 2025

(54) ROTATING INDEXING COUPLING (RIC) ASSEMBLY FOR INSTALLATION AND ORIENTATION OF A SUBSEA PRODUCTION TREE

(71) Applicant: FMC Technologies, Inc., Houston, TX (US)

(72) Inventor: Richard Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 18/514,336

(22) Filed: Nov. 20, 2023

(65) Prior Publication Data

US 2024/0084660 A1 Mar. 14, 2024

Related U.S. Application Data

(63) Continuation of application No. 17/312,862, filed as application No. PCT/US2018/065126 on Dec. 12, 2018, now Pat. No. 11,885,194.

(51) Int. Cl.
*E21B 33/038* (2006.01)
*E21B 33/035* (2006.01)

(52) U.S. Cl.
CPC ..... *E21B 33/038* (2013.01); *E21B 33/0353* (2020.05)

(58) Field of Classification Search
CPC ... E21B 33/038; E21B 33/0353; E21B 33/043
See application file for complete search history.

(56) References Cited

U.S. PATENT DOCUMENTS

2020/0399973 A1* 12/2020 Mitchell ..... E21B 33/0407

* cited by examiner

*Primary Examiner* — James G Sayre
(74) *Attorney, Agent, or Firm* — Osha Bergman Watanabe & Burton LLP

(57) ABSTRACT

One illustrative apparatus disclosed herein includes a stab body, a first and second inlet/outlet and a coupler body positioned around the stab body, wherein the coupler body is adapted to rotate relative to the stab body. Also included is a first and second hydraulic coupling element positioned on the coupler body and a first and second coiled tube positioned around the stab body, the first and second coiled tubes being in fluid communication with the first and second hydraulic coupling elements respectively and the first and second inlet/outlets respectively. Also included is a first and second orientation structure and a tubing hanger. The first and second orientation structures are adapted to engage each other and establish a desired relative orientation between the coupler body and the tubing hanger.

15 Claims, 14 Drawing Sheets

ROTATING INDEXING COUPLING (RIC) ASSEMBLY FOR INSTALLATION AND ORIENTATION OF A SUBSEA PRODUCTION TREE

BACKGROUND

Typically, to produce hydrocarbon-containing fluids from a subsea reservoir, several oil and gas wells are often drilled in a pattern that spaces the wells apart from each other. Each of the wells typically comprises a Christmas tree or production tree that is mounted on a wellhead (i.e., high-pressure housing). The production tree contains a flowline connector or "tree connector" that is often configured horizontally and positioned off to one side of the production tree. The tree connector is adapted to be connected to a production conduit such as a flowline or a jumper at the sea floor. The production conduits from the trees are typically coupled to other components, such as manifolds, templates or other subsea processing units that collect or re-distribute the hydrocarbon-containing fluids produced from the wells.

When developing the field, the operator typically radially orients the tree connector, i.e., the production outlet of each of the trees, in a desired target radial orientation relative to an x-y grid of the subsea production field that includes the locations of one or more wells and the various pieces of equipment that have been or will be positioned on the sea floor. Such orientation is required to facilitate the construction and installation of the subsea flowlines and jumpers, and to ensure that the flow lines and/or jumpers are properly positioned relative to all of the other equipment positioned on the sea floor. Proper orientation of subsea production trees is particularly important in template applications.

A typical subsea wellhead structure has a high-pressure wellhead housing secured to a low-pressure housing, such as a conductor casing. The wellhead structure supports various casing strings that extend into the well. One or more casing hangers are typically landed in the high-pressure wellhead housing, with each casing hanger being located at the upper end of a string of casing that extends into the well. A string of production tubing extends through the production casing for conveying production fluids, in which the production tubing string is supported using a tubing hanger. The area between the production tubing and the production casing is referred to as the annulus.

Wells that comprise vertical completion arrangements typically plan for the tubing hanger to be landed in and supported by the wellhead. A production tree is operatively coupled to the wellhead structure so as to control the flow of the production fluids from the well. The tubing hanger typically comprises one or more passages that may include a production passage, an annulus passage, and various passages for hydraulic and electric control lines. At least some production trees typically comprise a plurality of vertically oriented isolation tubes that stab vertically into engagement with various vertically oriented passages in the tubing hanger when the production tree lands on the wellhead. These stabbed interconnections between the tree and the tubing hanger fix the vertical spacing and relative radial orientation between the production outlet of the tree and the tubing hanger.

Since setting the radial orientation of the tubing hanger effectively sets the radial orientation of the production outlet, efforts are made to properly orient the tubing hanger within the wellhead when the tubing hanger is installed. The traditional methods involved in properly orienting the production outlet of a production tree typically requires accounting for multiple tolerances as it relates to the installation of several components relative to the positioning of other components. As noted above, proper orientation of subsea production trees is particularly important in subsea template applications primarily because the connection between the production tree and the manifold is a direct connection. Typically, present-day subsea template systems involve the use of very long flow loops on the manifold or on the production tree, or possibly on both the manifold and the production tree, to account for all of the system tolerances so as to enable a proper connection between the production tree and the manifold. A structure or system that includes such flow loops is extremely large and heavy.

Traditional methods used to properly orient a traditional tubing hanger may be relatively complex. For example, the radial orientation of the tubing hanger is typically accomplished by using the blowout preventer (BOP) assembly for guidance. The BOP assembly typically contains an orientation pin that can be extended into the bore through the BOP. The tubing hanger is attached to running string that typically includes a tubing hanger running tool (THRT) so that the tubing hanger may be installed in the wellhead. The running string also includes an orientation member, e.g., an orientation sub, that typically has a helix groove formed on its outer surface that is adapted to engage the orientation pin of the BOP assembly when the orientation pin in the BOP is extended into the bore through the BOP. As the tubing hanger running tool passes through the BOP, the interaction between the BOP orientation pin and the helix groove on the orientation sub orients the tubing hanger at the proper radial orientation within the wellhead. While the use of the BOP to orient the tubing hanger is effective, such a technique requires modification of the BOP on a per-field basis and sometimes on a per-well basis.

Additionally, various problems may arise with respect to the installation of production trees and operatively coupling those production trees to a tubing hanger. Typically, the control of the operation of a producing well may involve using pressurized hydraulic fluid to actuate one or more downhole valves and/or to cause a downhole component, such as a hydraulic cylinder, to be actuated. In other embodiments, one or more of the flow paths may be employed to introduce chemicals at one or more locations within the well. In some embodiments, several flow paths are established from the surface so as to provide, for example, a fluid communication path with a downhole device or structure that may need to be actuated to accomplish desired tasks within the well or to provide chemicals at a particular location within the well. In some applications, these flow paths are provided by drilling holes in a structure, such as a tubing hanger or a sub, where the holes are radially spaced apart at different orientations (when viewed from above) on the structure. Each of these holes is connected to an annular circular cavity that is defined between an outer surface of an inner component, an inner surface of an outer component and upper and lower seals between the two components. Such arrangements are sometimes referred to as radial seals. One problem with such radial seals is that, as the number of operations to be performed downhole increases, e.g., as more downhole valves need to be actuated (e.g., 15 or more), the overall length of the assembly positioned in the well may become exceedingly long since each of the radial seal compartments are typically positioned adjacent one another (when looking at a side view of the components of the well). Additionally, with such a configuration of the radial seals, the failure of a shared seal between two adjacent radial seal compartments has the effect of causing loss of control of the downhole components (e.g., valves) that were intended to be separately controlled by applying isolated pressure to each of what were intended to be isolated radial seal compartments. Such a situation can be detrimental to the efficient functioning or production of an oil and gas well, and may necessitate expensive remedial actions to correct the problems.

The present application is directed to various embodiments of a rotating indexing coupling (RIC) assembly for use during installation and orientation of a subsea production tree that may eliminate or at least minimize some of the problems noted above.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

The present application is generally directed to various embodiments of a rotating indexing coupling (RIC) assembly for use during installation and orientation of a subsea production tree. In one example, an apparatus disclosed herein includes a stab body, at least one inlet/outlet and a coupler body positioned around the stab body, wherein the coupler body is adapted to rotate relative to the stab body. In this example, the apparatus also includes at least one hydraulic coupling element positioned on the coupler body and at least one coiled tube positioned around the stab body, wherein the at least one coiled tube is in fluid communication with the at least one hydraulic coupling element positioned on the coupler body and the at least one inlet/outlet.

Another illustrative apparatus disclosed herein includes a stab body, first and second inlets/outlets, a coupler body positioned around the stab body, wherein the coupler body is adapted to rotate relative to the stab body, and first and second hydraulic coupling elements positioned on the coupler body. In this example, the apparatus also includes first and second separate coiled tubes positioned around the stab body, a first pressure-tight conduit that comprises the first inlet/outlet, the first coiled tube and the first hydraulic coupling element, a second pressure-tight conduit that comprises the second inlet/outlet, the second coiled tube and the second hydraulic coupling element, wherein the first pressure-tight conduit is isolated from the second pressure-tight conduit. This embodiment of the apparatus also includes a tubing hanger, first and second hydraulic coupling elements positioned on the tubing hanger, wherein the first and second hydraulic coupling elements on the tubing hanger are, respectively, operatively coupled to the first and second hydraulic coupling elements on the coupler body, a first orientation structure positioned on either the coupler body or the tubing hanger and a second orientation structure positioned on the other of the coupler body or the tubing hanger, wherein the second orientation structure and the first orientation structure are adapted to engage one another so as to establish a desired relative orientation between the coupler body and the tubing hanger.

One illustrative method disclosed herein includes attaching at least one hydraulic coupling element to a tubing hanger, securing the tubing hanger within a subsea well and operatively coupling an apparatus to a bottom of a subsea production tree, wherein the apparatus includes a stab body, at least one inlet/outlet, a coupler body positioned around the stab body that is adapted to rotate relative to the stab body, at least one hydraulic coupling element positioned on the coupler body and at least one coiled tube positioned around the stab body, wherein the at least one coiled tube is in fluid communication with the at least one hydraulic coupling element positioned on the coupler body and the at least one inlet/outlet. In this example, the method also includes lowering at least the production tree and the attached apparatus toward the subsea well until an orientation key engages at least one angled surface, continues lowering the production tree/apparatus so as to further insert the apparatus into the subsea well, whereby the combined weight of the production tree/apparatus forces the orientation key to travel along at least a portion of the at least one angled surface and causes the coupler body to rotate relative to the stab body, continue lowering the production tree/apparatus so as to further cause the coupler body to rotate until the orientation key registers in the orientation slot, thereby vertically aligning the at least one hydraulic coupling element positioned on the coupler body with the at least one hydraulic coupling element on the tubing hanger, and continue lowering the production tree/apparatus so as to cause the at least one hydraulic coupling element positioned on the coupler body and the at least one hydraulic coupling element on the tubing hanger to operatively engage one another.

Yet another illustrative method disclosed herein includes attaching at least one hydraulic coupling element to a tubing hanger, installing the tubing hanger in its final installed position within a subsea well, wherein the tubing hanger includes a first orientation structure, determining an as-installed orientation of the first orientation structure with respect to a reference grid or another structure, and positioning an apparatus at a surface location, wherein the apparatus includes a stab body, at least one inlet/outlet, a coupler body positioned around the stab body, at least one hydraulic coupling element positioned on the coupler body, at least one coiled tube positioned around the stab body, the at least one coiled tube being in fluid communication with the at least one first hydraulic coupling element positioned on the coupler body and the at least one inlet/outlet and a second orientation structure on the coupler body, wherein the second orientation structure and the first orientation structure are adapted to engage one another so as to establish a desired relative orientation between the coupler body and the tubing hanger. In this example, the method also includes coupling the apparatus to a production tree and, with the apparatus positioned at a surface location and coupled to the production tree, rotating the coupler body around the stab body until such time as the second orientation structure is at a desired orientation whereby when the second orientation structure is in a final registered position with respect to the first orientation structure, the at least one hydraulic coupling element positioned on the coupler body will be operatively coupled to the at least one hydraulic coupling element on the tubing hanger. This illustrative method also includes lowering at least the production tree and the attached apparatus until the second orientation structure on the apparatus is positioned in its final registered position with respect to the first orientation structure and the at least one hydraulic coupling element positioned on the coupler body is operatively coupled to the at least one hydraulic coupling element on the tubing hanger.

Another illustrative apparatus disclosed herein includes a tubing hanger with a body and a bore extending through the body, a plurality of orientation slots positioned around an outside perimeter of the body and an orientation key positioned in one of the orientation slots.

BRIEF DESCRIPTION OF DRAWINGS

Certain aspects of the presently disclosed subject matter will be described with reference to the accompanying drawings, which are representative and schematic in nature and are not considered to be limiting in any respect as it relates to the scope of the subject matter disclosed herein.

Figure 1:
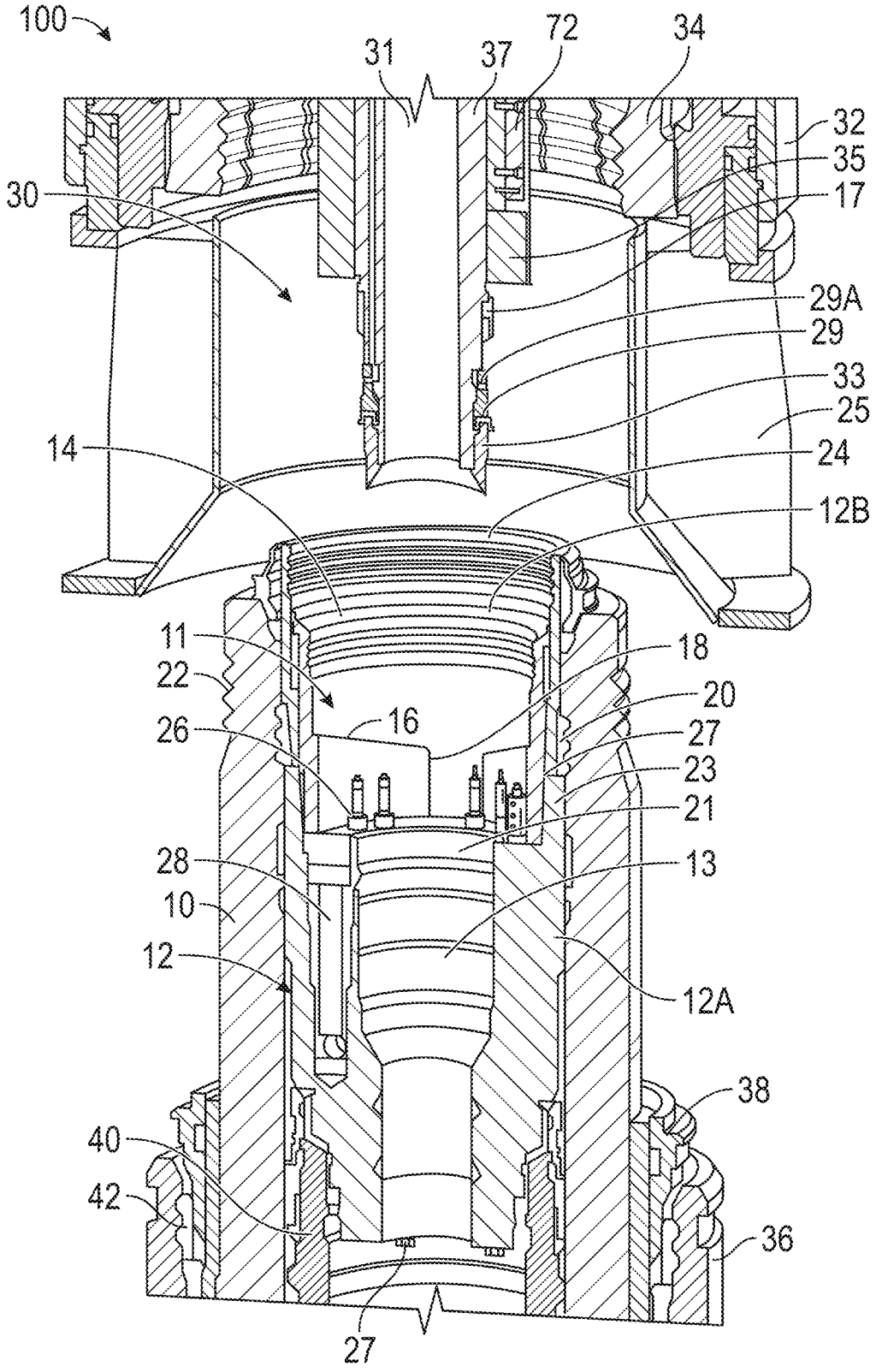
FIGS. 1-11 depict various aspects of one illustrative example of a novel rotating indexing coupling (RIC) assembly disclosed herein that may be employed when landing and orienting a subsea production tree.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIGS. 1-11 depict various aspects of one illustrative example of a novel rotating indexing coupling (RIC) assembly 30 (best seen in FIG. 8) disclosed herein that may be employed when landing and orienting a subsea production tree Various aspects and components of one illustrative embodiment of an apparatus or system 100 that includes one illustrative embodiment of the RIC assembly 30 are depicted in the attached drawings. With reference to FIG. 1, the RIC assembly 30 may be installed in an illustrative wellhead system that includes a conductor pipe 36 positioned in the sea floor, a rigid lock assembly 38 (that includes dogs 42) and a high-pressure wellhead housing 10 that is secured within the conductor pipe 36 by actuation of the rigid lock assembly 38. An illustrative casing hanger 40 is landed and secured within the wellhead 10.

An illustrative tubing hanger 12 is landed within the casing hanger 40 and secured within the well. In the illustrative example depicted herein, the tubing hanger 12 comprises two components—a main (or lower) tubing hanger body 12A and an upper tubing hanger body 12B, with a surface 14 near the top of the upper tubing hanger body 12B. However, as will be appreciated by those skilled in the art after a complete reading of the present application, the tubing hanger 12 may be comprised of more than the two illustrative components depicted herein or it may be a single, unitary body. The main tubing hanger body 12A includes a production seal bore 13 and an annulus seal bore 21. The upper tubing hanger body 12B is secured to the main tubing hanger body 12A by a threaded connection 23, and a seal is provided between the two components. Also depicted in FIG. 1 is a plurality of male-configured wetmate hydraulic coupling elements 26 that are operatively coupled to the main tubing hanger body 12A. In one illustrative embodiment, the coupling elements 26 comprise metal seal elements (not shown). Each of coupling elements 26 is in fluid communication with a unique individual opening (or flow passage) (not shown) drilled down through the main tubing hanger body 12A in a direction that is generally parallel to the central axis of the production bore 13. Representative outlets 27 of these flow passages in the tubing hanger 12 are shown in FIG. 1 at the bottom of the tubing hanger 12.

Figure 2:
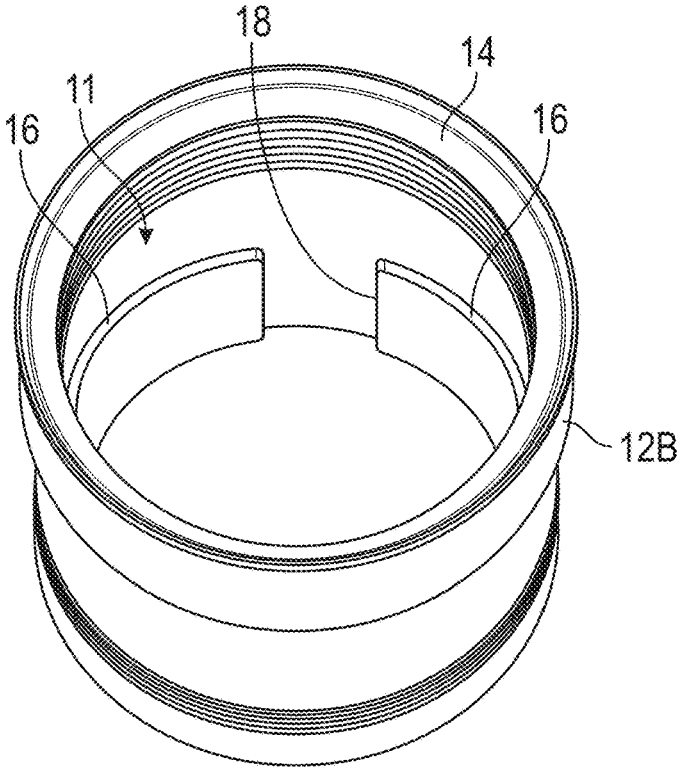
Figure 3:
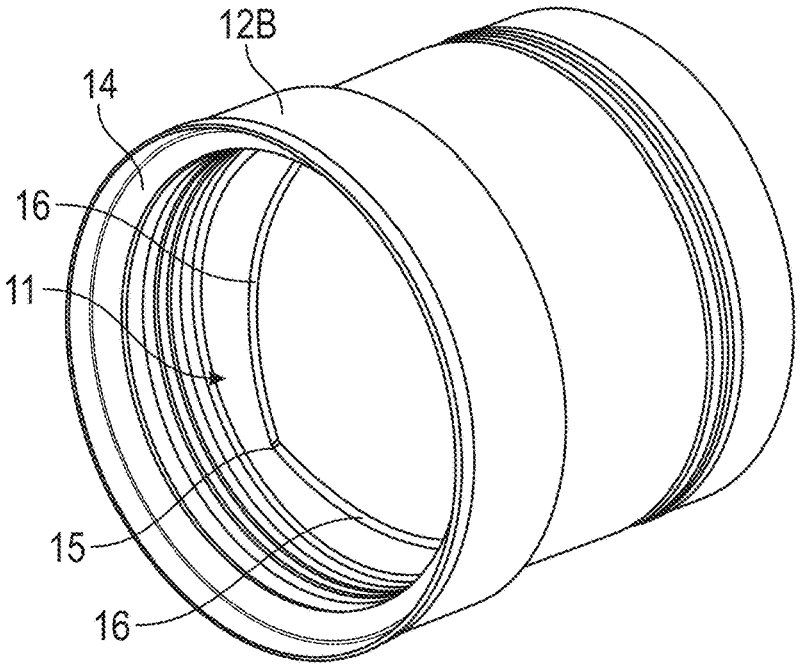

In one illustrative embodiment, a guide structure 11 is formed in the tubing hanger 12. In the depicted example, the guide structure 11 is formed in the upper tubing hanger body 12B. FIGS. 2 and 3 are perspective views of the upper tubing hanger body 12B that show further details of one illustrative embodiment of the guide structure 11. As depicted, the guide structure 11 comprises a plurality of angled guide surfaces 16, the upper ends of which meet at an apex 15. An orientation recess or slot 18 is positioned adjacent to the bottom end of the angled guide surfaces 16. In one illustrative example, the angled guide surfaces 16 may be helical surfaces. As will be appreciated by those skilled in the art after reading the present application, the guide structure 11 is intended to be representative of any type of structure or mechanism that permits or assists in ultimately positioning an orientation key 80 (discussed below) in the orientation slot 18)

Also depicted in FIG. 1 are a sliding sleeve 28, wellhead locking grooves 22, tubing hanger locking dogs 20, a tree guide funnel 25, a valve block 32 of an illustrative production tree, and a plurality of collet clamps 34 that are adapted to engage the locking grooves 22 on the wellhead 10 to secure the production tree to the wellhead.

Figure 4:
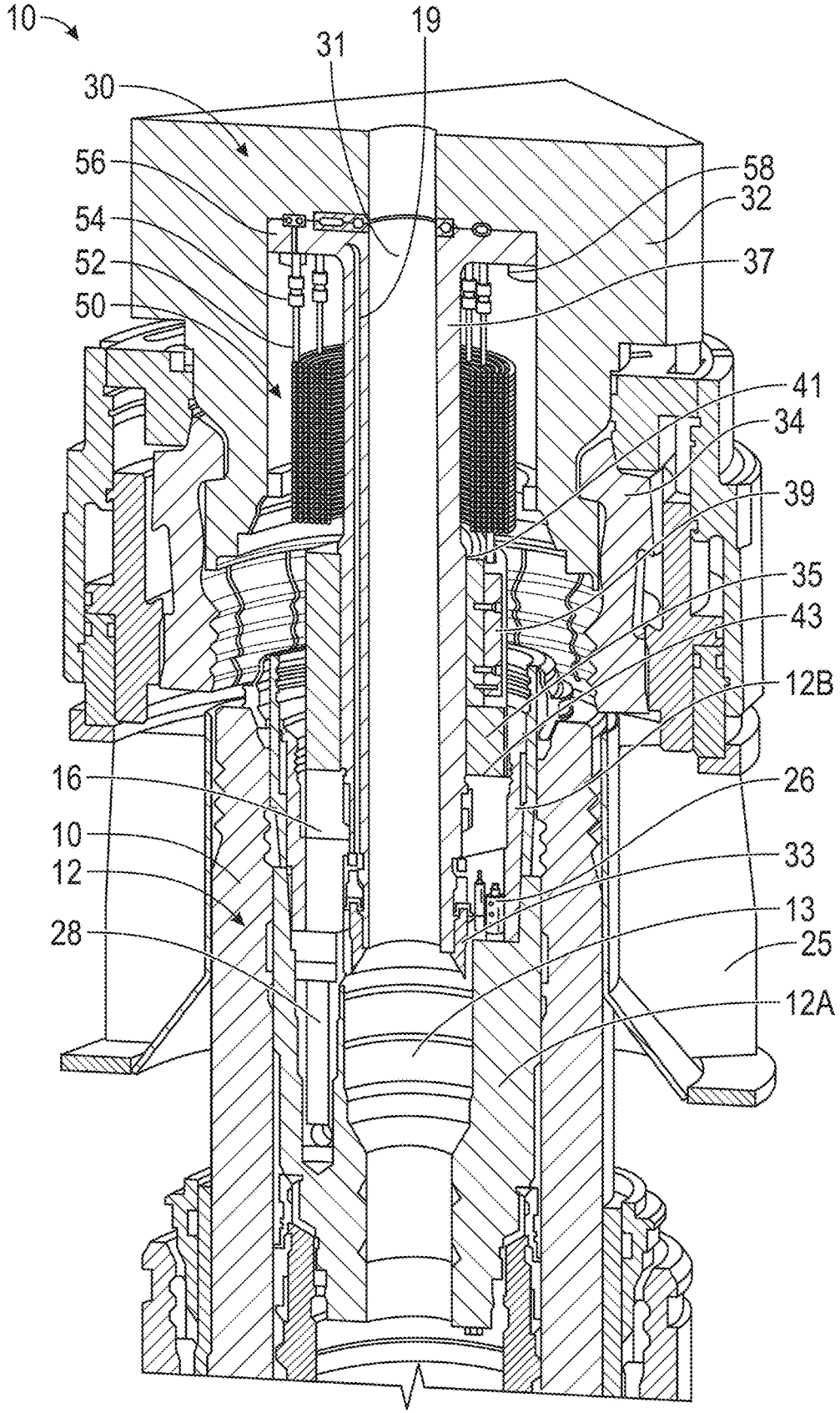
Figure 5:
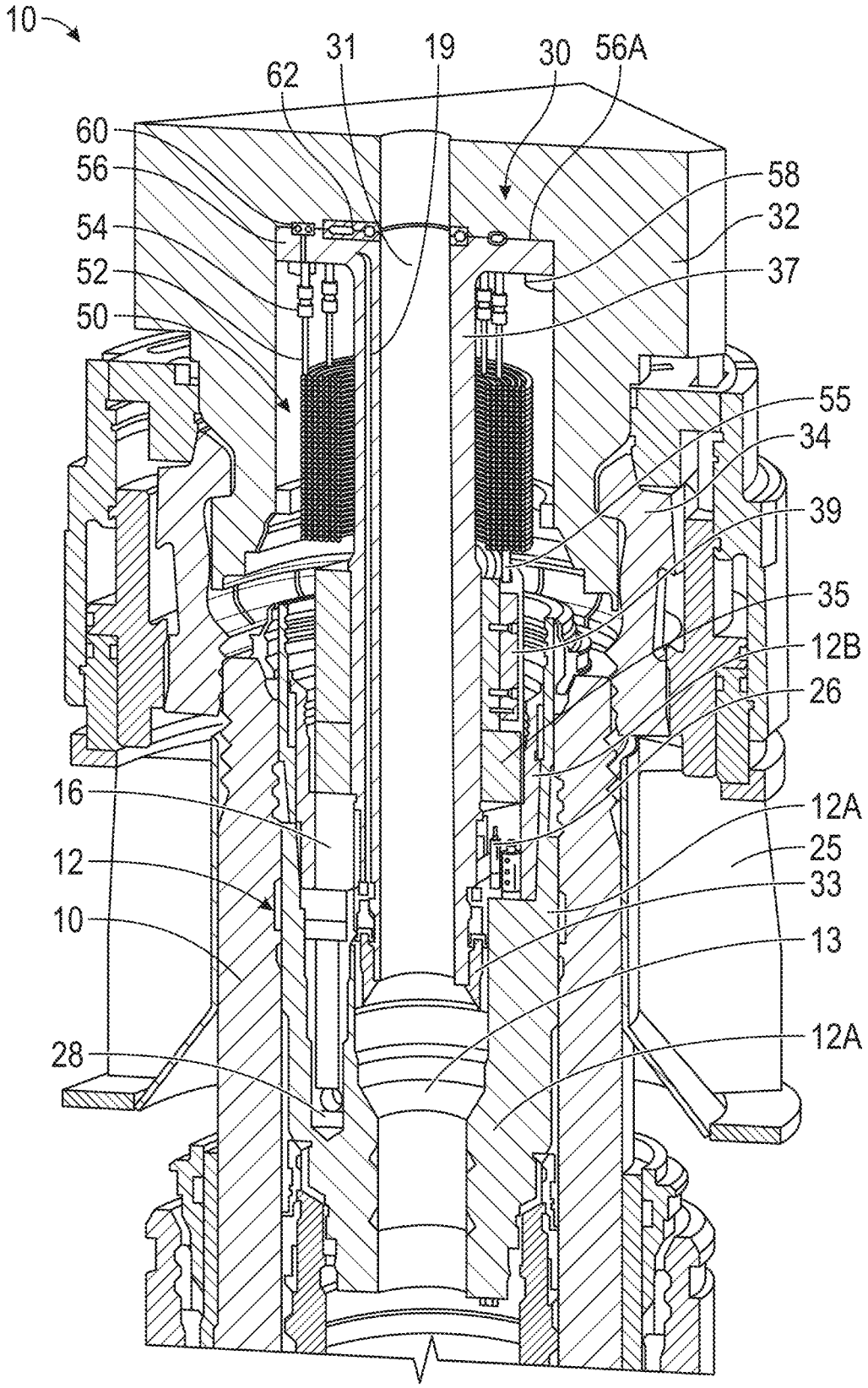
Figure 8:
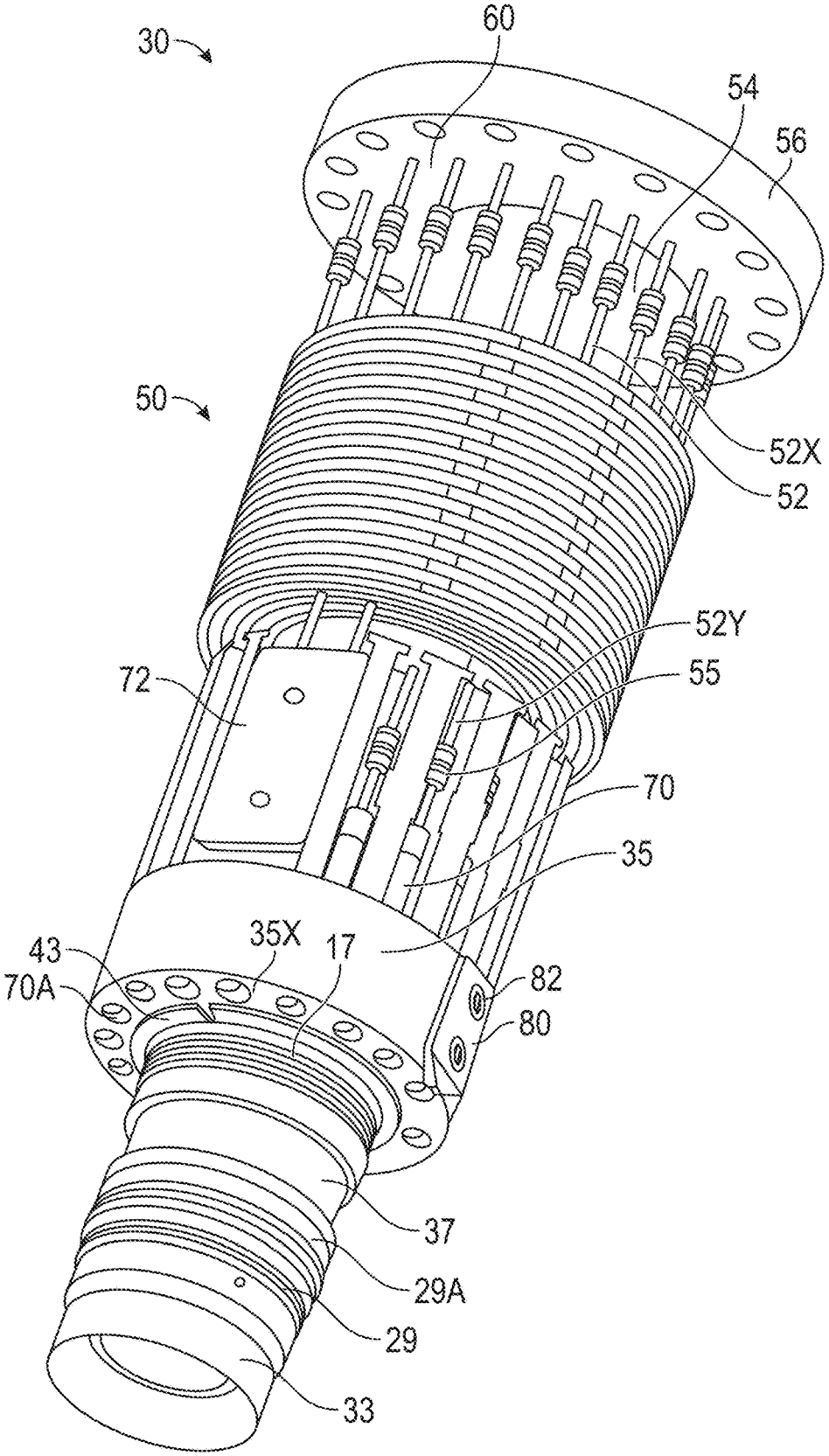
Figure 9:
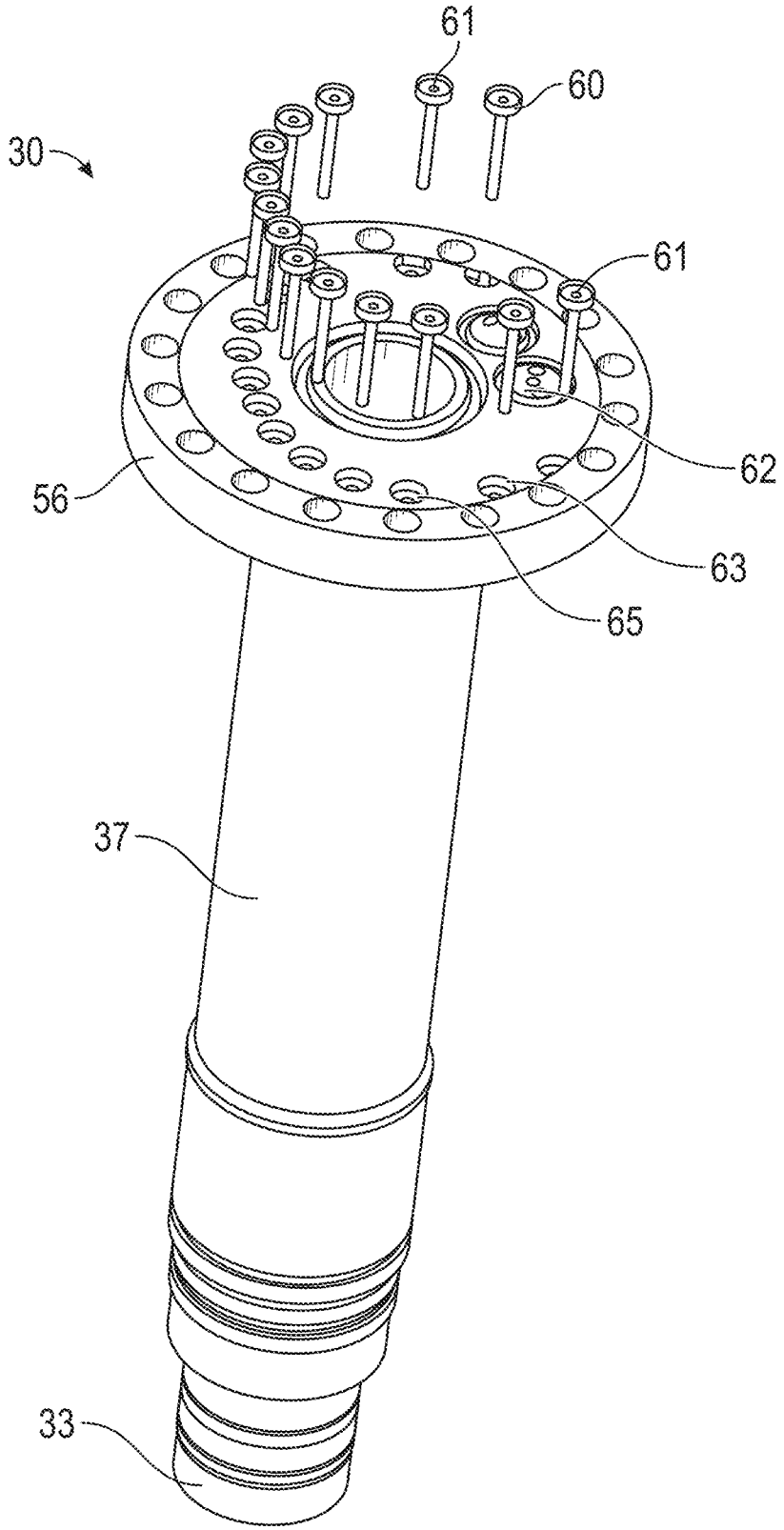

FIG. 1 only depicts the lower portion of the RIC assembly 30. A perspective view of the RIC assembly 30 is shown in FIG. 8. In general, in one illustrative embodiment, the RIC assembly 30 includes a production and annulus stab body 37 (that includes a stab assembly bore 31) and a coupler body 35. A perspective view of the stab body 37 is shown in FIG. 9. The coupler body 35 is adapted to rotate around the stab body 37, as will be described more fully below. An illustrative and optional protection plate 72 is coupled to the coupler body 35 by a plurality of threaded fasteners. As best seen in FIG. 4, the coupler body 35 is positioned in a groove or recess formed on and/or in the outer surface of the stab body 37. In one illustrative example, the recess is vertically defined by an upper shoulder 41 and a lower snap ring 43 that is operatively coupled to the stab body 37. The shoulder 41 and the snap ring 43 prevent relative vertical movement between the coupler body 35 and the stab body 37. In general, in one embodiment, the stab body 37 and the coupler body 35 are manufactured such that there is sufficient clearance between the two components to permit the coupler body 35 to rotate around the stab body 37 when the RIC assembly 30 is inserted into the well. In the depicted example, there are no bearings positioned between the stab body 37 and the coupler body 35 so as to facilitate this rotation, but such bearings may be provided in some applications. The RIC assembly 30 also includes a flange 56 at the upper end of the stab body that is adapted to be coupled to the production tree, e.g., the valve block 32, with a plurality of threaded fasteners 58. A production bore sealing assembly 33 is positioned at the lower end of the RIC assembly 30. The production bore sealing assembly 33 includes a primary production seal 29 (metal or elastomer) and a back-up production seal 29A (metal or elastomer). An annulus seal 17 (metal or elastomer) is positioned above the production bore sealing assembly 33. The annulus seal 17 is adapted to seal with the annulus seal bore 21 in the tubing hanger 12. As best seen in FIG. 5, a plurality of annulus holes 19 (only one of which is shown) are formed in the stab body 37. In one illustrative embodiment, thirty-six such annulus holes 19 may be formed in the stab body 37. A ganged annulus fluid collection region 62 is coupled to the flange 56 and provides a point of convergence of the fluid flowing to or from each of the annulus holes 19. A similar ganged annulus fluid collection region (not shown) that is in fluid communication with the bottom of the annulus holes 19 is provided above the back-up production seal 29A.

Figure 10:
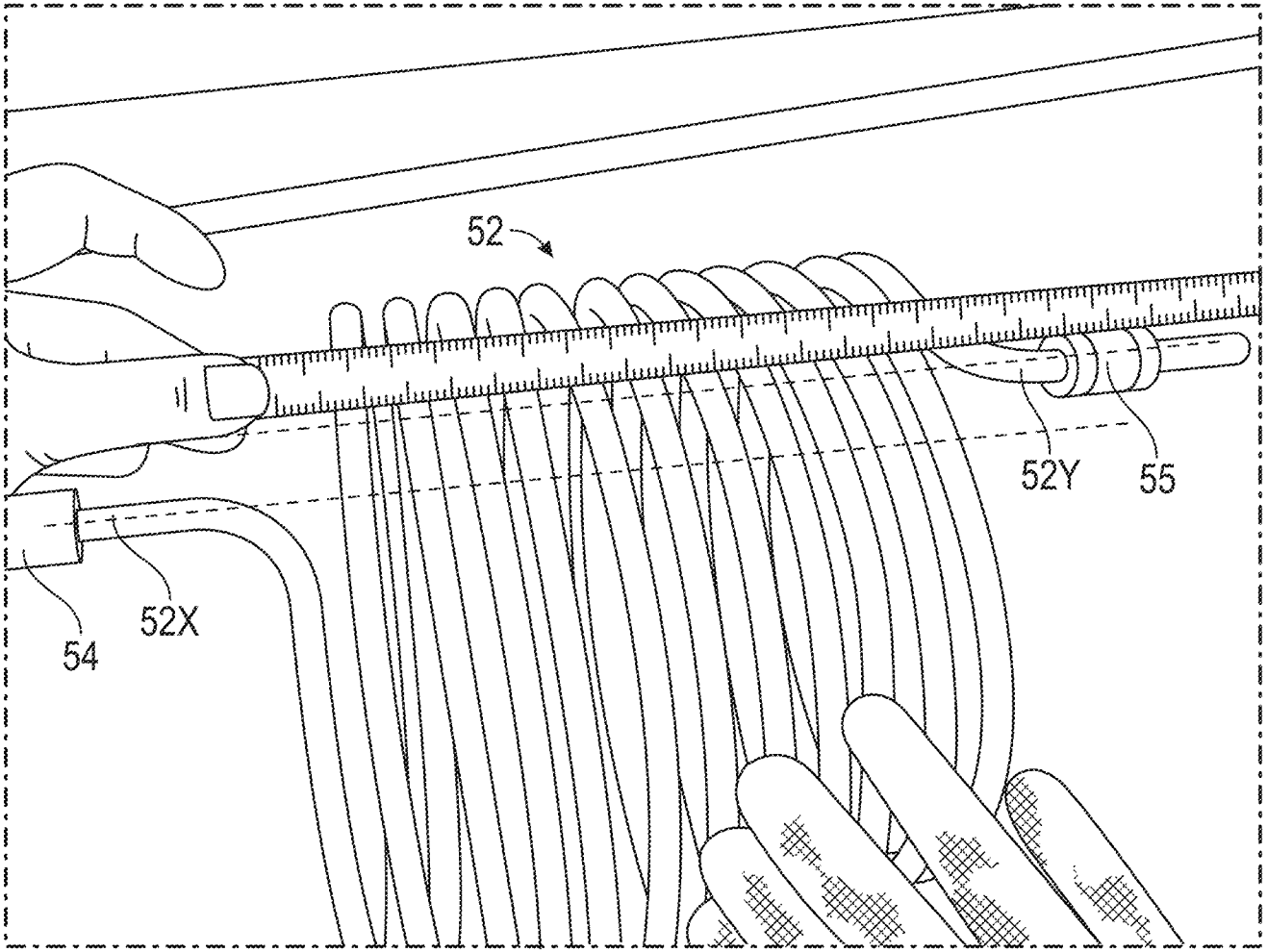

The RIC assembly 30 also includes a collection 50 of a plurality of individual coiled tubes 52. One of the illustrative coiled tubes 52 is shown in FIG. 10. There is an annular space between the inside diameter defined by the collection of tubes 50 and the outside diameter of stab body 37 so as permit the inside diameter of the collection of tubes 50 to contract when the coupler body 35 rotates in a certain direction, e.g., clockwise, around the stab body 37. Conversely, the outer diameter defined by the collection of tubes 50 effectively expands when the coupler body 35 rotates in the opposite direction, e.g., counterclockwise, around the stab body 37. The size and number of such individual coiled tubes 52 may vary depending upon the particular application. In one illustrative embodiment, fifteen individual coiled tubes 52 may be included in the collection of coiled tubes 50. However, the number of individual coiled tubes 52 may vary depending upon the particular application, e.g., some applications may only have a single individual coiled tube 52, while other applications may include any desired number of individual coiled tubes 52. In one example, at least one coiled tube 52 may be provided so as to provide a conduit for one or more electrical/communication lines, and at least one other coiled tube 52 may be provided to provide a pressure-tight conduit for a liquid, such as a chemical to be injected into the formation. In one illustrative embodiment, each of the individual coiled tubes 52 may be 9.53 mm (0.375 inch) OD tubing. Of course, it is not required that all of the individual coiled tubes 52 be the same size, although that may be the case in some applications. The coiled tubes 52 may be comprised of any material, e.g., stainless steel.

Figure 7:
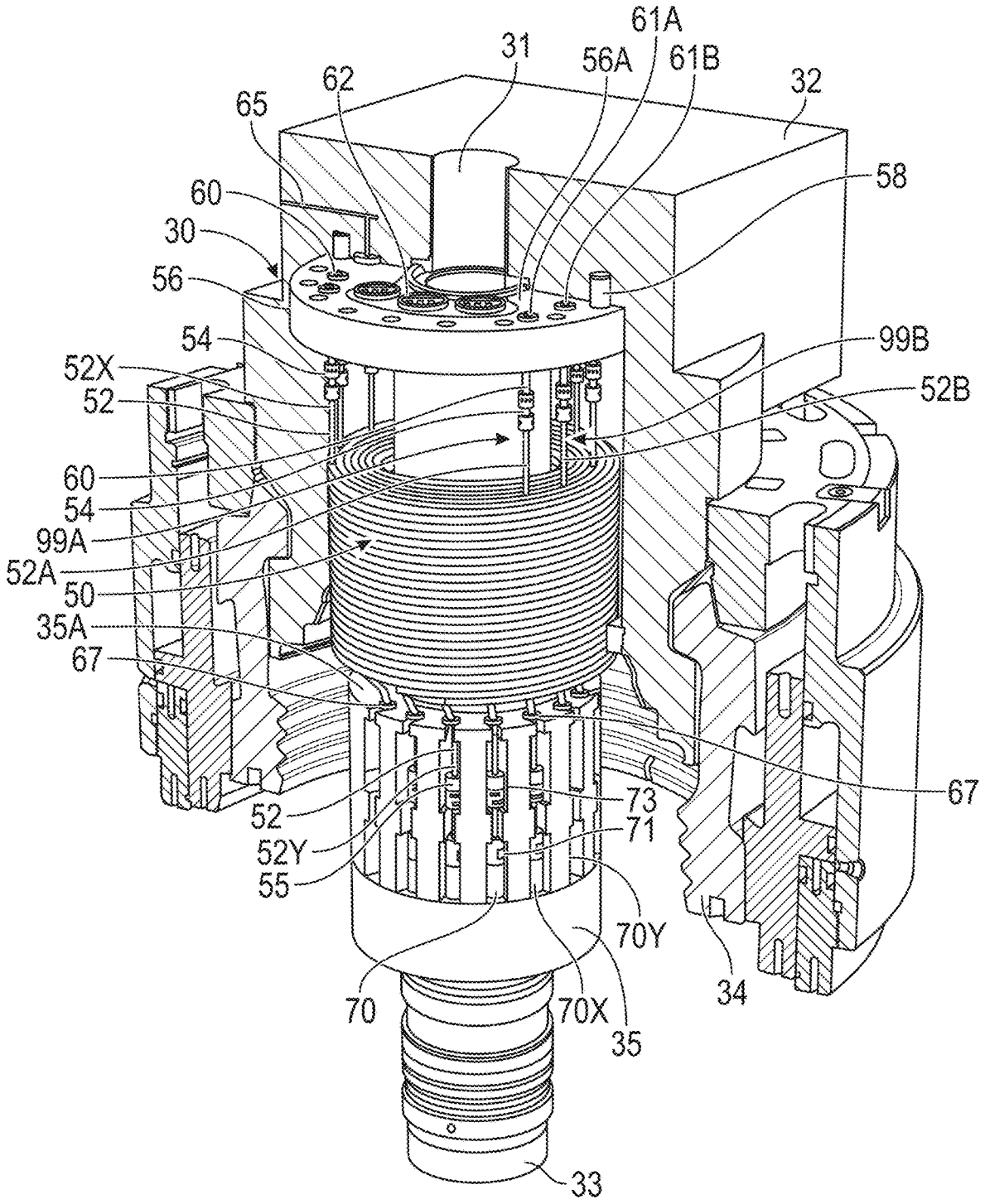

In general, once assembled, each of the individual coiled tubes 52 will be a portion of a separate, unique and isolated flow path for fluids, such as hydraulic fluid or chemicals, as well as a path through which electrical cable or wiring may be routed. With reference to FIGS. 7-10 the upper portion of the RIC assembly 30 includes, in this illustrative example, a plurality of illustrative tubing communication devices 60 that extend through the flange 56. In the broadest sense, each of the individual coiled tubes 52 will be in fluid communication with a single upper inlet/outlet 61 positioned at some location above the collection 50 of coiled tubes 52. In the depicted example, the apparatus is provided with a plurality of tubing communication devices 60, wherein each of the communications devices comprises one inlet/outlet 61. In the depicted example, the tubing communication devices 60 may be welded into position in a corresponding recess 63 in the front face of the flange 56 so as to position the inlet/outlets 61 adjacent an upper surface 56A of the flange 56. In this example, as shown in FIG. 7, the system includes a plurality of individual passageways 65 (only one of which is shown) in the production tree 32, wherein each individual passageway 65 is in fluid communication with a single one of the inlet/outlets 61. In the depicted example, each of the tubing communication devices 60 will be operatively coupled to an upper end 52X of one of the individual coiled tubes 52. As best seen in FIGS. 7 and 8, the lower end of each of the tubing communication devices 60 will be sealingly coupled to an upper end 52X of an individual coiled tube 52 by a pressure-containing connection 54. The pressure-containing connection 54 may take a variety of forms. In one illustrative embodiment, the pressure-containing connection 54 may be a fitting or it may be a simple welded connection.

Of course, as will be appreciated by those skilled in the art after a complete reading of the present application, the illustrative tubing communication devices 60 are but one means by which the individual coiled tubes 52 may be placed in fluid communication with the upper surface (front face) of the flange 56. For example, all or part of the axial length of the opening through the flange 56 may be threaded, a portion of tubing above the pressure-containing connection 54 may also be threaded and the threaded tubing may be threadingly coupled to the threaded opening in the flange 56. As another example, the portion of tubing above the pressure-containing connection 54 may extend all the way to the upper surface (front face) of the flange 56 and be welded to the upper surface (front face) of the flange 56. In general, any means by which each of the individual coiled tubes 52 may be placed in fluid communication with a corresponding unique opening (i.e., inlet/outlet) in the upper surface (front face) of the flange 56 should be considered to fall within the scope of the presently disclosed subject matter. Moreover, the inlet/outlets 61 may be positioned on or in another structure or component of the system that includes the RIC assembly 30. For example, the inlets/outlets 61 may be positioned in the valve block 32 of the production tree. Other possible locations and arrangements may be recognized by those skilled in the art after a complete reading of the present application and such arrangements should be considered to be within the scope of the present inventions.

As best seen in FIG. 7, in one illustrative embodiment, a plurality of grommets 67 are provided at the upper end 35A of the coupler body 35. Each of the grommets 67 is adapted to receive a lower portion of one of the individual coiled tubes 52. Also depicted in FIG. 7 is a plurality of female-configured wetmate hydraulic coupling elements 70 each of which comprises a bottom opening 70A that may be accessed through an opening 35X (see FIG. 8) formed in the bottom of the coupler body 35. Each of the female-configured wetmate hydraulic coupling elements 70 is adapted to be operatively coupled to (or mate) one of the male-configured wetmate hydraulic coupling elements 26 positioned on the tubing hanger 12. However, as will be appreciated by those skilled in the art after a complete reading of the present application, the male/female configuration of the coupling elements 26/70 could be reversed if desired. The coupling elements 26/70 may be provided with elastomeric seals or metal seals (e.g., metal sealing coupling elements). The use of metal sealing coupling elements may prove to be more durable and may be operated in high-pressure, high-temperature environments.

As depicted, in one illustrative embodiment, a plurality of slots 73 are formed in the coupler body 35 so as to facilitate assembly of the various components described herein. With continuing reference to FIG. 7, the lower end 52Y of each of the individual coiled tubes 52 will be sealingly coupled to female-configured wetmate hydraulic coupling elements 70 by a pressure-containing connection 55. The pressure-containing connection 55 may take a variety of forms. In one illustrative embodiment, the pressure-containing connection 55 may be a fitting or it may be a simple welded connection. In the depicted example, a shoulder 71 in each of the slots 73 prevents the hydraulic coupling elements 70 from moving axially within the coupler body 35.

As will be appreciated by those skilled in the art after a complete reading of the present application, once assembled and connected to the other components (e.g., once each individual coiled tube 52 is connected to one of the devices 60 and one of the coupling elements 70) and sealed connections 54 and 55 are established, each of the individual coiled tubes 52 provides a unique and isolated pressure-tight conduit that provides fluid communication between the upper surface of the flange 56 of the RIC assembly 30 to outlets 70A at the bottom of the coupling elements 70. For example, with reference to FIG. 7, the RIC assembly 30 includes a first pressure-tight conduit 99A that includes the fluid inlet/outlet 61A, the coiled tube 52A and the hydraulic coupling element 70X positioned on the coupler body 35. Similarly, the RIC assembly 30 includes a second pressure-tight conduit 99B that includes the fluid inlet/outlet 61B, the coiled tube 52B and the hydraulic coupling element 70Y positioned on the coupler body 35, wherein the first pressure-tight conduit 99A is isolated from the second pressure-tight conduit 99B.

As will be appreciated by those skilled in the art after a complete reading of the present application, the isolated pressure-tight conduits (e.g., the illustrative conduits 99A, 99B) of the presently disclosed apparatus provide a significant advantage relative to the prior art radial seals arrangement briefly discussed in the background section of this application. As noted above, given the side-by-side arrangement of the radial seal compartments, the failure of a shared seal between two adjacent radial seal compartments has the effect of causing loss of control of two of the downhole components (or operations) that were intended to each be separately controlled by applying pressure (or fluid) to each of what were intended to be isolated radial seal compartments. In contrast, a failure of one of the isolated pressure-tight conduits of the present apparatus only results in loss of control of the single downhole component (or operation) that was controlled by that single failed isolated pressure-tight conduit. Additionally, the overall length of the assembly using the isolated pressure-tight conduits disclosed herein may be significantly less than the overall length of an assembly of a comparable apparatus comprised of a plurality of the radial seals (positioned side-by-side along the length of the apparatus). Of course, other advantages may be recognized by those skilled in the art after a complete reading of the present application.

Moreover, when the couplings 26 and 70 are operatively coupled to one another as the RIC assembly 30 is landed in the well, each of the individual coiled tubes 52 is in fluid communication with one of the outlets 27 of the flow passages in the bottom of the tubing hanger 12. Each of these unique and isolated pressure-tight conduits provides a means by which various fluids, e.g., hydraulic fluids, chemicals, etc., may be provided through the coupled hydraulic elements 26/70 and the outlets 27 in the tubing hanger 12 to perform a variety of functions downhole within the well. Such functions may include, for example, actuating downhole valves or pistons, applying hydraulic pressure to move various structures, supply chemicals at desired locations within the well, etc. Additionally, electrical or communication wiring may be routed down through one or more of the unique and isolated pressure-tight conduits to provide power and/or to establish electrical communication with regions or devices positioned below the tubing hanger 12.

As best seen in FIG. 8, in one illustrative embodiment, an orientation key 80 is attached to the coupler body 35. In this example, the orientation key 80 is a separate component that may be attached to the coupler body 35 with a plurality of threaded fasteners 82. After the RIC assembly 30 is coupled to the production tree at the surface, the combination of at least the production tree 32 and the RIC assembly 30 (other components may be attached to the production tree 32 as well) is towered toward the well. As the RIC assembly 30 is lowered downward within the well, the orientation key 80 is adapted to initially engage one of the angled guide surfaces 16 on the guide structure 11 formed in the tubing hanger 12. At that point, the combined weight of the combination of the tree 32 and the RIC assembly 30 causes the orientation key 80 to travel downward along one of the angled guide surfaces 16 thereby causing the coupler body 35 to rotate relative to the stab body 37. The rotation of the coupler body 35 continues until such time as the orientation key 80 falls into or registers with the orientation slot 18 in the guide structure 11 in the tubing hanger 12. At that point further relative rotation between the coupler body 35 and the tubing hanger 12 is prevented. When the orientation key 80 is registered or positioned in the orientation slot 18, the bottom opening 70A of each of the coupling elements 70 (e.g., a female coupling) is vertically aligned with a single corresponding coupling element 26 (e.g., a male coupling) positioned on the tubing hanger 12. At that point, the combination of the production tree 32 and the RIC assembly 30 is further lowered to hydraulically couple the hydraulic elements 26/70 to one another in their final mated position. Note that, although the coupler body 35 rotates relative to the stab body 37 as the RIC assembly 30 engages the guide structure 11, the production tree 32 (coupled to the flange 56 of the RIC assembly) does not rotate to any appreciable degree during the process of establishing the mated connection between the hydraulic elements 26/70. As will be appreciated by those skilled in the art after a complete reading of the present application, the orientation key 80 may travel down either of the angled, guide surfaces 16 on the guide structure 11 and, accordingly, the coupler body 35 may rotate around the stab body 37 for about 180 degrees in either a clockwise or counterclockwise direction (depending upon which angled guide surface 16 the orientation key 80 initially engages) as the RIC assembly 30 moves downward within the well.

As will be appreciated by those skilled in the art after a complete reading of the present application, in the broadest sense, the system disclosed herein includes a first orientation structure or mechanism positioned on one of the coupler body 35 or the tubing hanger 12 and a second orientation structure or mechanism positioned on the other of the coupler body 35 or the tubing hanger 12, wherein the second orientation structure and the first orientation structure are adapted to engage one another so as to establish a desired relative orientation between the coupler body 35 and the tubing hanger 12. When the first and second structures are in a final registered and fully installed position with respect to one another, the hydraulic coupling elements 70 positioned on the coupler body 35 will be operatively coupled to the hydraulic coupling elements 26 on the tubing hanger 12. Additionally, with reference to the specific examples depicted herein, the first orientation structure may comprise either the orientation slot 18 or the orientation key 80 and the second orientation structure may comprise the other of the orientation slot 18 or the orientation key 80.

The production tree 32 will typically be lowered toward the wellhead with the production outlet of the production tree 32 properly oriented relative to an x-y grid of the subsea production field or some item of subsea equipment, such as a reference mark (or the like) on the wellhead 10. Once it is confirmed that that the production outlet of the production tree 32 is, in fact, in the final desired orientation, the production tree 32 may be coupled to the wellhead. However, if necessary, after the mated connection is established between the hydraulic elements 26/70, the production tree 32 and the stab body 37 (of the RIC assembly 30) may be rotated to fine tune or adjust the orientation of the production outlet of the production tree 32 to its desired orientation. During this rotation process, the stab body 37 is free to rotate relative to the coupler body 35. Of course, the final mated connection between the hydraulic elements 26/70 remains intact throughout this process.

Figure 11:
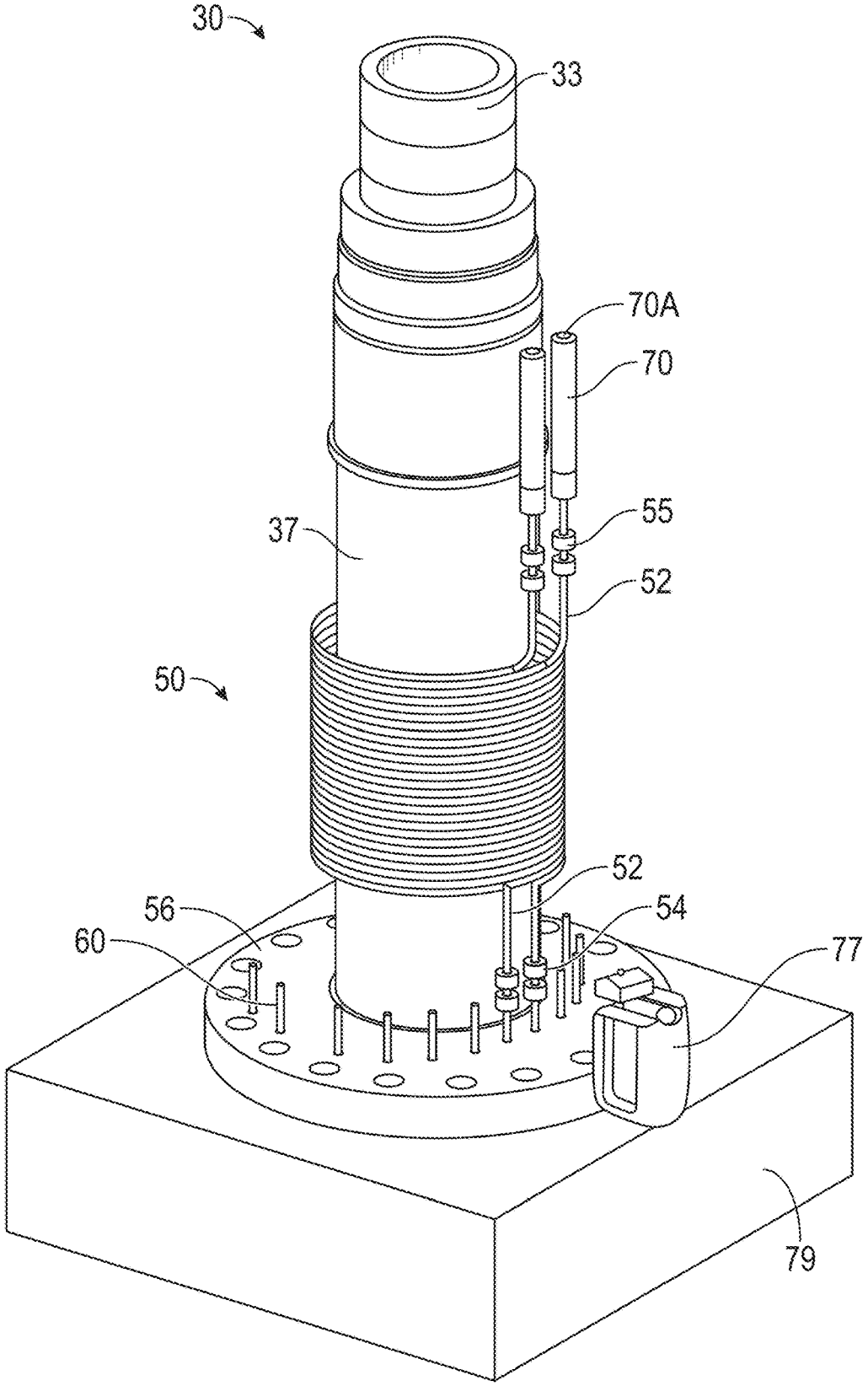

FIG. 11 depicts the RIC assembly 30 at a stage of partial assembly wherein two illustrative individual coiled tubes 52 have been installed around the stab body 37. In this example, the upper face of the flange 56 has been positioned on a stand 79 for purposes of assembly. A simplistically depicted tool 77 that may be employed in making and/or assembling the pressure-tight connections 54 and 55 is also depicted. Also depicted in FIG. 11 are two female-configured wetmate hydraulic coupling elements 70, each of which is operatively coupled to one of the individual coiled tubes 52.

One illustrative novel method of installing a production tree using the novel structures disclosed herein will now be generally described. Ultimately, the production tree (or any particular outlet of the tree) will need to be oriented relative to another subsea structure, such as a production flow hub that is coupled to a subsea manifold, or some other reference system. Relatively precise orientation of the production tree is required such that connecting components, such as subsea jumpers or flow lines, are properly aligned and may be properly coupled between the subsea components, e.g., between a production tree and a subsea manifold or a pipeline sled.

With reference to FIG. 1, at some point after the casing hanger 40 has been installed in the well, the tubing hanger 12 (e.g., the combination of the main tubing hanger body 12A and the upper tubing hanger body 12B in the depicted example of the tubing hanger 12) will be coupled to a tubing hanger running tool (THRT) (not shown) and run into the well through a BOP (blowout preventer) (not shown) that is coupled to the wellhead 10. However, in the illustrative example depicted herein, prior to attaching the tubing hanger 12 to the THRT, the upper tubing hanger body 12B will be threadingly coupled to the main tubing hanger body 12A at the surface. As part of this process, the upper tubing hanger body 12B is rotated to position the orientation slot 18 at a specific orientation such that, with the production outlet of the production tree 32 at its desired orientation, when the orientation key 80 registers or is positioned in the orientation slot 18, the bottom opening 70A of each of the coupling elements 70 (e.g., a female coupling) will be vertically aligned with a single corresponding coupling element 26 (e.g., a male coupling). In the depicted example, the orientation key 80 is positioned on the coupler body 35 while the orientation slot 18 is positioned on the main tubing hanger body 12A. Once the orientation of the orientation slot 18 is at its desired location, an anti-rotation pin or mechanism (not shown) will be engaged to prevent any further relative rotation between the main tubing hanger body 12A and the upper tubing hanger body 12B. At that point, the tubing hanger 12 will be attached to the THRT, run into and landed in the well and the tubing hanger locking dogs 20 will be actuated to secure the tubing hanger 12 within the well. Importantly, the tubing hanger 12 is landed and locked in position within the well without regard to the orientation of the tubing hanger 12 relative to any other structure or reference system.

Figure 6:
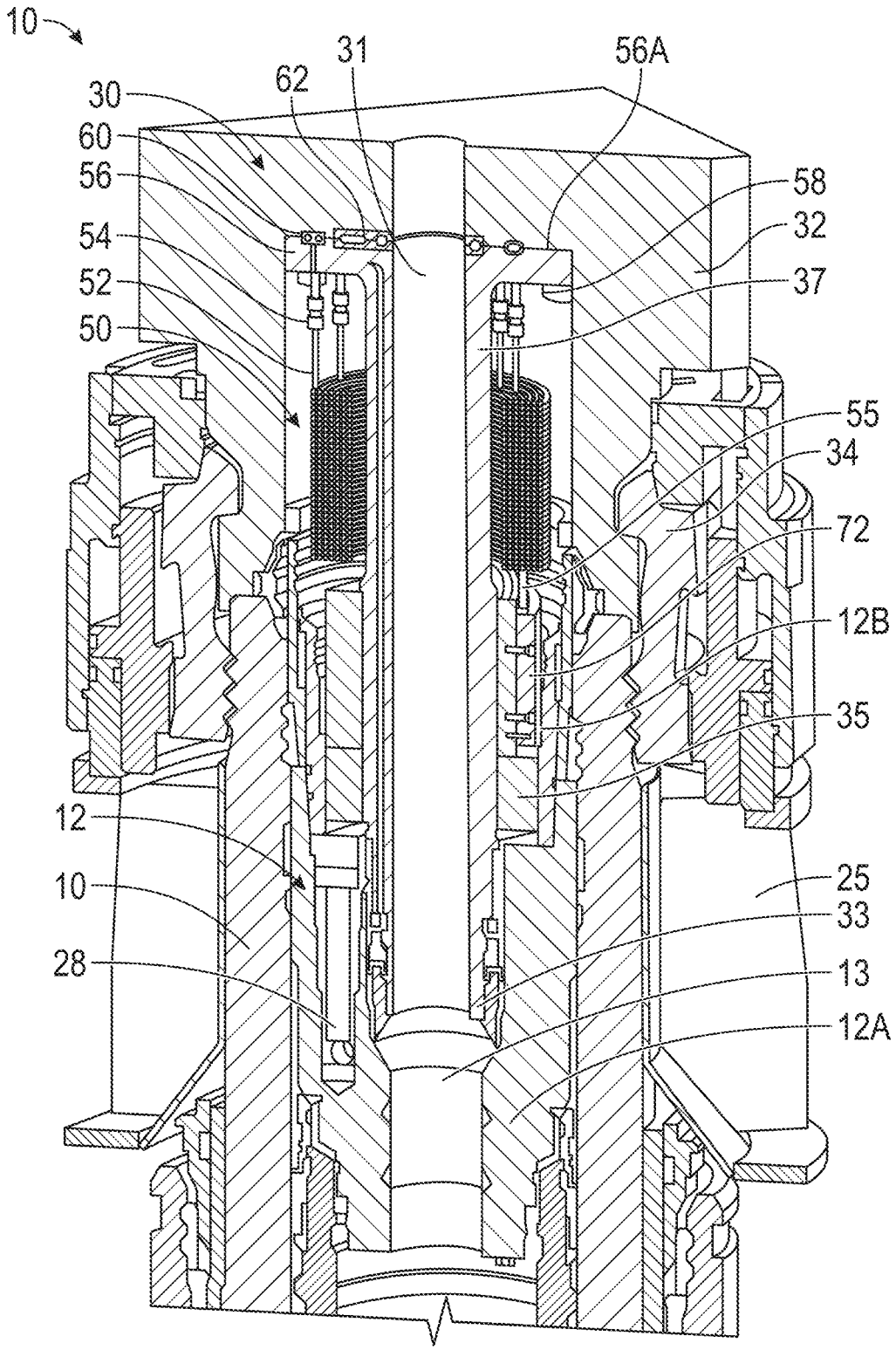

All of the following actions will be observed using an ROV. Next, the BOP is decoupled from the wellhead 10 and removed. Thereafter, the combination of the production tree and the RIC assembly 30, which had been previously coupled to the production tree, is lowered toward the wellhead 10, with the production outlet of the production tree 32 in its desired orientation. FIG. 1 depicts the well at a point in time where the production bore sealing assembly 33 portion of the RIC assembly 30 is just about to be introduced into the well. FIG. 4 depicts the well at a point in time where the lower portion of the coupler body 35 is positioned within the tubing hanger 12. At this point, the orientation key 80 (see FIG. 8) has not yet engaged either of the angled guide surfaces 16 of the guide structure 11. FIG. 5 depicts the well at a point in time wherein the apparatus has been lowered further into the well as indicated by, among other things, the positioning of the production bore sealing assembly 33 portion of the RIC assembly 30 down further within the tubing hanger production bore 13. At this point, the orientation key 80 (see FIG. 8) has already engaged one of the angled guide surfaces 16 of the guide structure 11 and the coupler body 35 has begun to rotate around production stab 37 as the combination of the production tree 32 and the RIC assembly 30 is further lowered. FIG. 6 depicts the well at a point in time where the rotation of the coupler body 35 was continued until such time as the orientation key 80 engaged and registered with the orientation slot 18 in the guide structure 11. As noted above, positioning of the orientation key 80 within the orientation slot 18 vertically aligns the bottom opening 70A of each of the coupling elements 70 (e.g., a female coupling) with a single corresponding coupling element 26 (e.g., a male coupling) positioned on the tubing hanger 12. Thereafter, continued downward movement of the combination of the production tree 32 and the RIC assembly 30 results in mating engagement between all of the coupling elements 70 on the RIC assembly 30 with all of the coupling elements 26 on the tubing hanger 12. FIG. 6 depicts the RIC assembly 30 in its final installed position with respect to the tubing hanger 12. As thus installed, a plurality of unique and isolated pressure-containing conduits (each of which includes one of the individual coiled tubes 52 and one of the inlets/outlets 61) is established from the tubing hanger 12 to the production tree, e.g., the valve block 32 of the production tree. Importantly, the rotation of the coupler body 35 was accomplished only by using the weight of the combination of the production tree and the RIC assembly 30 (as well as any other components that may be attached to the tree) to cause the rotation of the coupler body 35 as the orientation key 80 on the RIC assembly 30 engaged and travels down one of the angled guide surfaces 16 of the guide structure 11.

FIGS. 12-15 depict various aspects of another illustrative example of a novel rotating indexing coupling (RIC) assembly 30 disclosed herein that may be employed when landing and orienting a subsea production tree. In the previous version, the coupler body 35 was allowed to freely rotate around the stab body 37 as the RIC assembly 30 was lowered within the well due to the interaction between the orientation key 80 and one of the angled guide surfaces 16. Thus, the orientation of the hydraulic coupling elements 70 on the bottom of the RIC assembly 30 relative to the coupling elements 26 on the tubing hanger 12 was "passive" in nature in that the proper orientation of the coupling elements 70/26 was achieved by simply lowering the combination of the production tree/RIC assembly 30 into the well and allowing the coupler body 35 to freely rotate until such time as the orientation key 80 landed in the orientation slot 18. In contrast, in this second embodiment, the relative rotational position between the coupler body 35 and the stab body 37 will be established at the surface, e.g., on a ship or an offshore platform, prior to running the combination of the production tree/RIC assembly 30 onto the well 10. This embodiment includes motion-limiting means for retarding relative rotation between the coupler body 35 and the stab body 37. The motion-limiting means is provided as a means for resisting the maximum anticipated torsional reaction moment from the collection 50 of the individual tubes 52 as the outer diameter of the overall collection 50 of tubes 52 expands or contracts as the coupler body 35 is rotated relative to the stab body 37 as described above (for at most about 180° in either direction). Of course, as will be appreciated by those skilled in the art after a complete reading of the present application, the spring-based motion-limiting means (described below) is but one of many different means or devices that may be provided to achieve this purpose. As one illustrative alternative, the stab body 37 and coupler body 35 may be sized such that there with be some degree of interaction between the two components, e.g., a frictional force that must be overcome to begin to allow the coupler body 35 to rotate relative to the stab body 37. Thus, the means for resisting the torsional reaction moment of the collection 50 of the individual tubes 52 should not be considered to be limited to the particular example described below.

Figure 12:
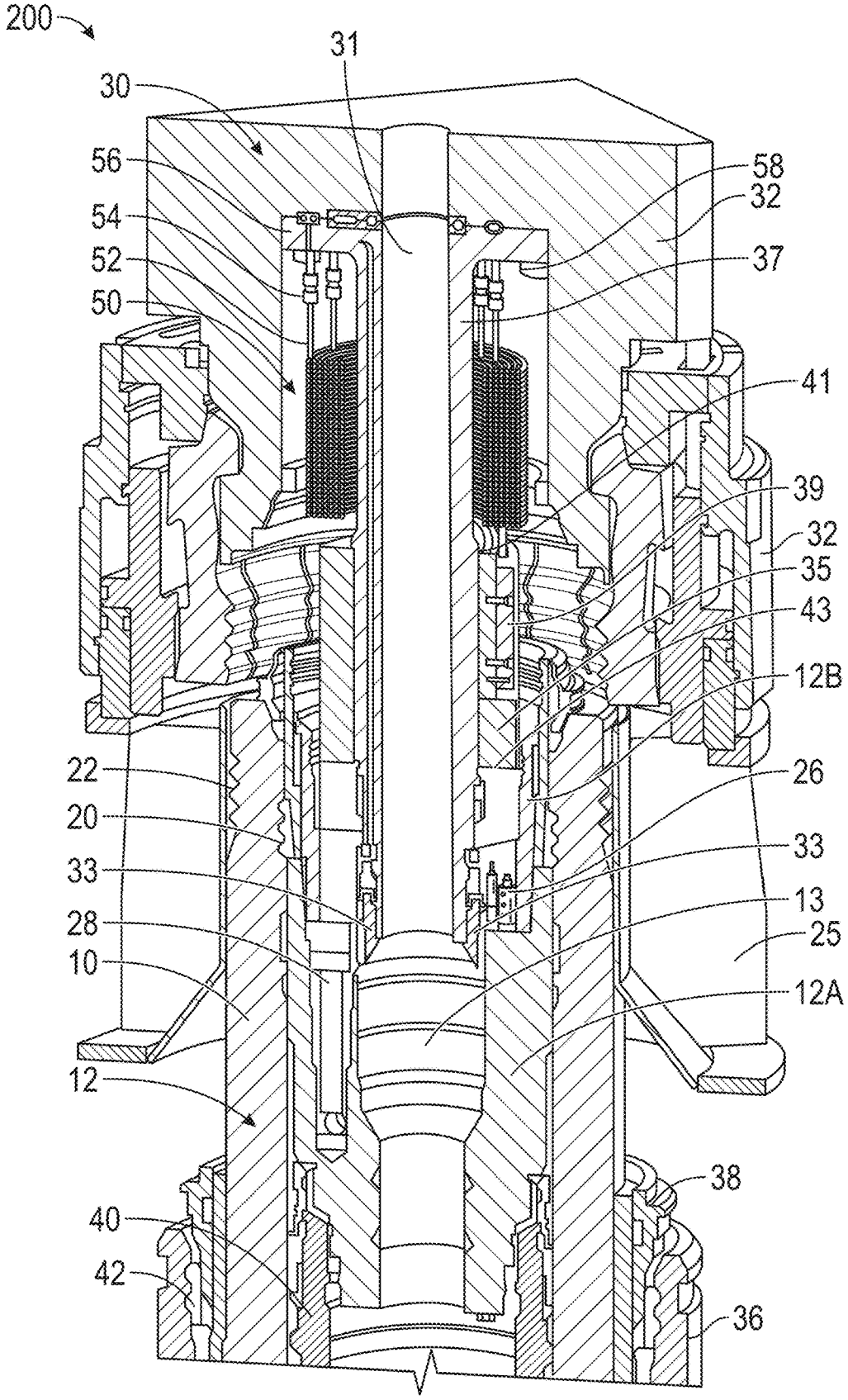
FIGS. 12-15 depict various aspects of another illustrative example of a novel rotating indexing coupling (RIC) assembly disclosed herein that may be employed when landing and orienting a subsea production tree.

FIG. 12 depicts the well at a point in time corresponding to the point in time shown in FIG. 4. In this embodiment, all of the components of the RIC assembly 30, the tubing hanger 12 and the other structures are the same as before with at least two notable modifications that will be described with reference to FIG. 13. The use of this embodiment of the RIC assembly 30 is very similar to that disclosed above with respect to the previous embodiment with some notable exceptions. In all embodiments, the tubing hanger 12 may be run into the well without regard to the orientation of the orientation mechanism positioned on the tubing hanger 12, e.g., either the orientation slot 18 or the orientation key 80. In the depicted example, the orientation slot 18 is positioned on the tubing hanger 12 and that is the example that will be discussed hereinafter. With the tubing hanger 12 in its as-installed, fixed position within the well, the as-installed orientation of the orientation slot 18 is fixed and may be determined using an ROV tool.

Figure 13:
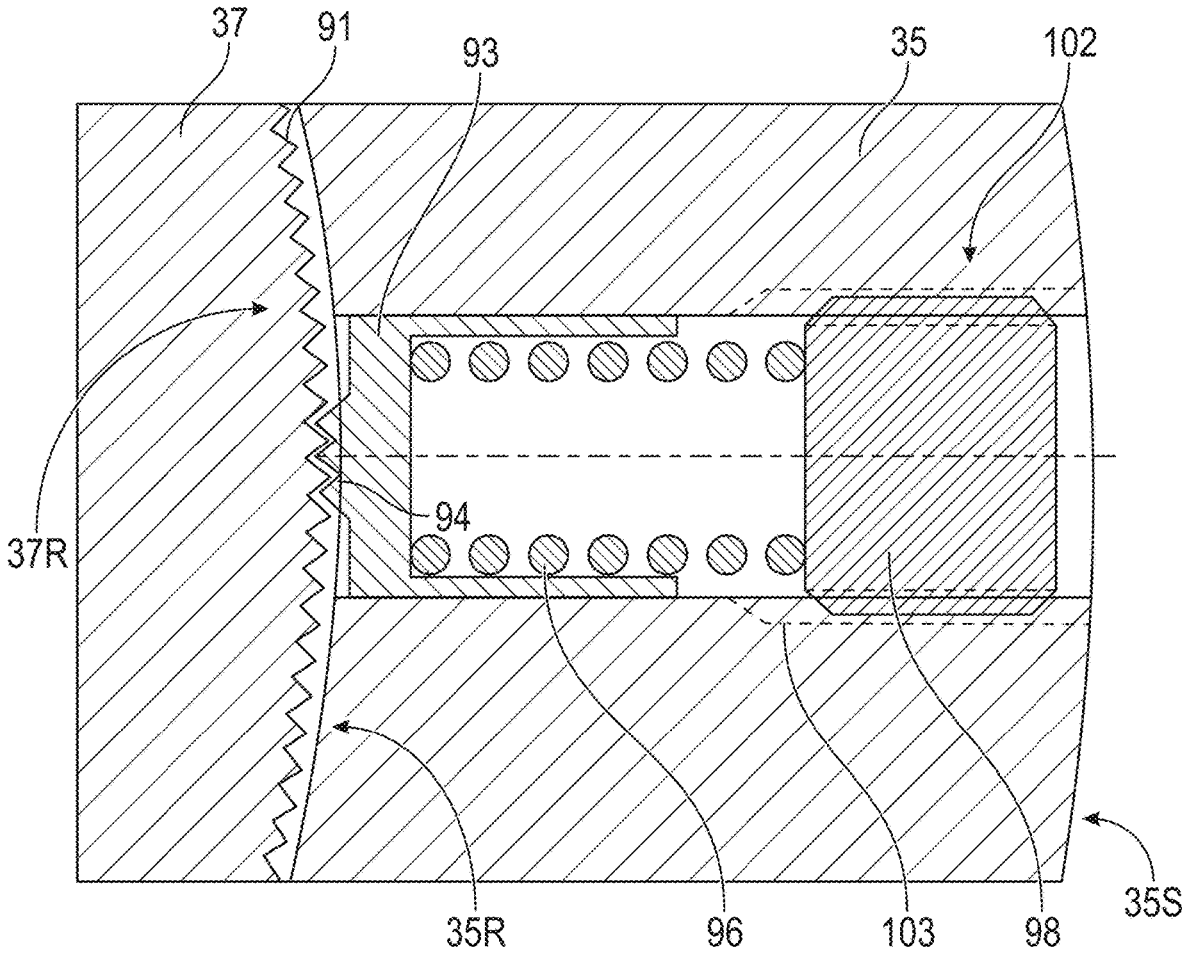

In the depicted example, the motion-limiting means comprises a rotation restricting structure 102. As shown in FIG. 13, in this embodiment, at some location along the interface between the coupler body 35 and the stab body 37, e.g., at some location between the upper shoulder 41 and the lower snap ring 43, a plurality of anti-rotation structures 91, e.g., teeth, are formed on at least a portion of the outer surface 37R of the stab body 37. The rotation restricting structure 102 is provided at one or more locations on the coupler body 35. The inner and outer surfaces 35R and 35S, respectively, of the coupler body 35 are depicted in FIG. 13. In general, in this example, the rotation restricting structure 102 comprises a plurality of anti-rotation structures 94 that are adapted to engage at least one of the anti-rotation structures 91 on the outer surface 37R of the stab body 37. In one illustrative example, the rotation restricting structure 102 may comprise an internally threaded circular opening 103 that extends from the outer surface 35S to the inner surface 35R, a spring 96, an externally threaded spring retaining plug 98 and an anti-rotation body 93 that comprises anti-rotation structures 94.

In general, the rotation restricting structure 102 is assembled in the coupler body 35 at the surface as part of the overall RIC assembly 30. In that assembled position, the spring 96 of the rotation restricting structure 102 generates the desired amount of outward biasing force to maintain the engagement between the anti-rotation structures 91/94. Additionally, in this assembled position, the spring-force provided by the spring 96 of the rotation restricting structure 102 is set high enough to resist the above-described maximum anticipated torsional reaction moment from the collection 50 of the individual tubes 52 as the outer diameter of the overall collection 50 of tubes 52 expands or contracts as the coupler body 35 is rotated relative to the stab body 37. At that point, with the rotation restricting structure 102 in its assembled position, relative rotation between the stab body 37 and the coupler body 35 is retarded unless and until a sufficient rotational force is applied to the coupler body 35 to overcome the biasing spring-force of the spring 96. When rotational force applied to the coupler body 35 exceeds the biasing spring-force, the engagement and interaction between the angled surfaces of the anti-rotation structures 91, 94 will force the anti-rotation body 93 back into the opening 103 as the spring 96 is compressed, thereby allowing the coupler body 35 to rotate around the stab body 37 as the anti-rotation structures 91, 94 ratchet relative to one another. Once the rotational force applied to the coupler body 35 is less than the biasing spring-force, the ratcheting between the anti-rotation structures 91, 94 stops and relative movement between the stab body 37 and the coupler body 35 is again prevented unless and until the rotational force applied to the coupler body 35 again exceeds the biasing spring-force.

The actions described in this paragraph are after the RIC assembly 30 was coupled to the production tree 32 at the surface, e.g., on a ship or an offshore platform. As indicated above, in the depicted example, the orientation key 80 is at a fixed location on the perimeter of the coupler body 35. Accordingly, and with the knowledge of the as-installed orientation of the orientation slot 18, and with knowledge of the final desired orientation of the production outlet of the production tree 32, the coupler body 35 may be rotated relative to the stab body 37 to a desired or target as-installed position for the orientation key 80. This is accomplished by applying a torque to the coupler body 35 that is sufficient to overcome the spring-biasing force so as to allow the anti-rotation structures 91, 94 to ratchet relative to one another as the coupler body 35 is rotated to its desired relative rotational position relative to the stab body 37. As noted above, the rotation of the coupler body 35 also generates the above-described torsional reaction moment from the collection 50 of the individual tubes 52 as the outer diameter of the overall collection 50 of tubes 52 expands or contracts. When the coupler body 35 is rotated to its desired relative rotational position, the rotation of the coupler body 35 is stopped and the biasing force applied by the spring 96 is sufficient to urge the anti-rotation structures 91, 94 into engagement with one another with sufficient force such that the engaged anti-rotation structures 91,94 resist (or overcome) the torsional reaction moment from the collection 50 of the individual tubes 52 and maintain the coupler body 35 at its desired relative rotational position until such time as rotational force applied to the coupler body 35 is sufficient to overcome the biasing spring-force as described above. When the orientation key 80 is in its as-installed position on the coupler body 35, and when the orientation key 80 registers with or engages the orientation slot 18, the bottom opening 70A of each of the coupling elements 70 (e.g., a female coupling) will be vertically aligned with a single corresponding coupling element 26 (e.g., a male coupling) positioned on the tubing hanger 12.

Figure 14:
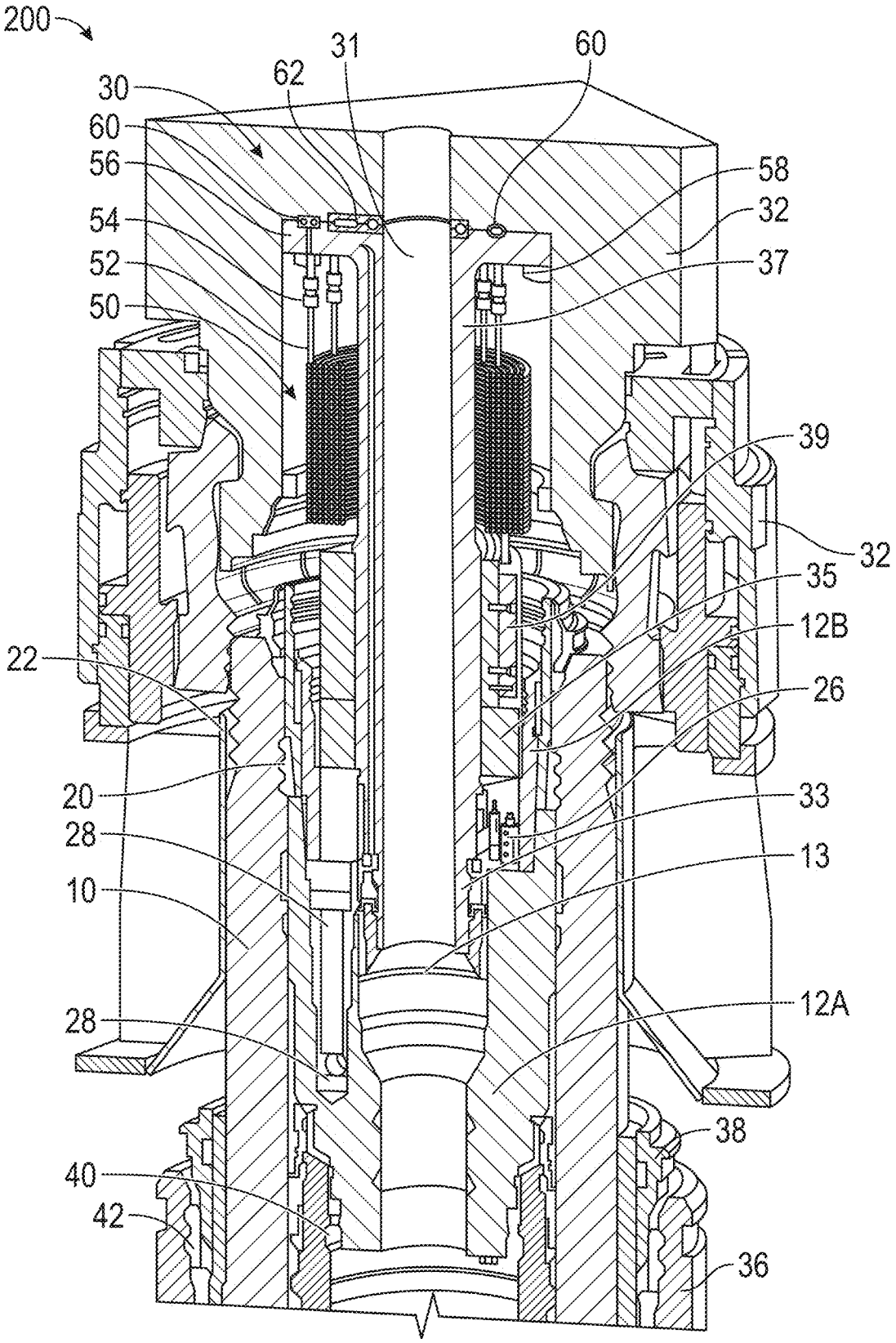
Figure 15:
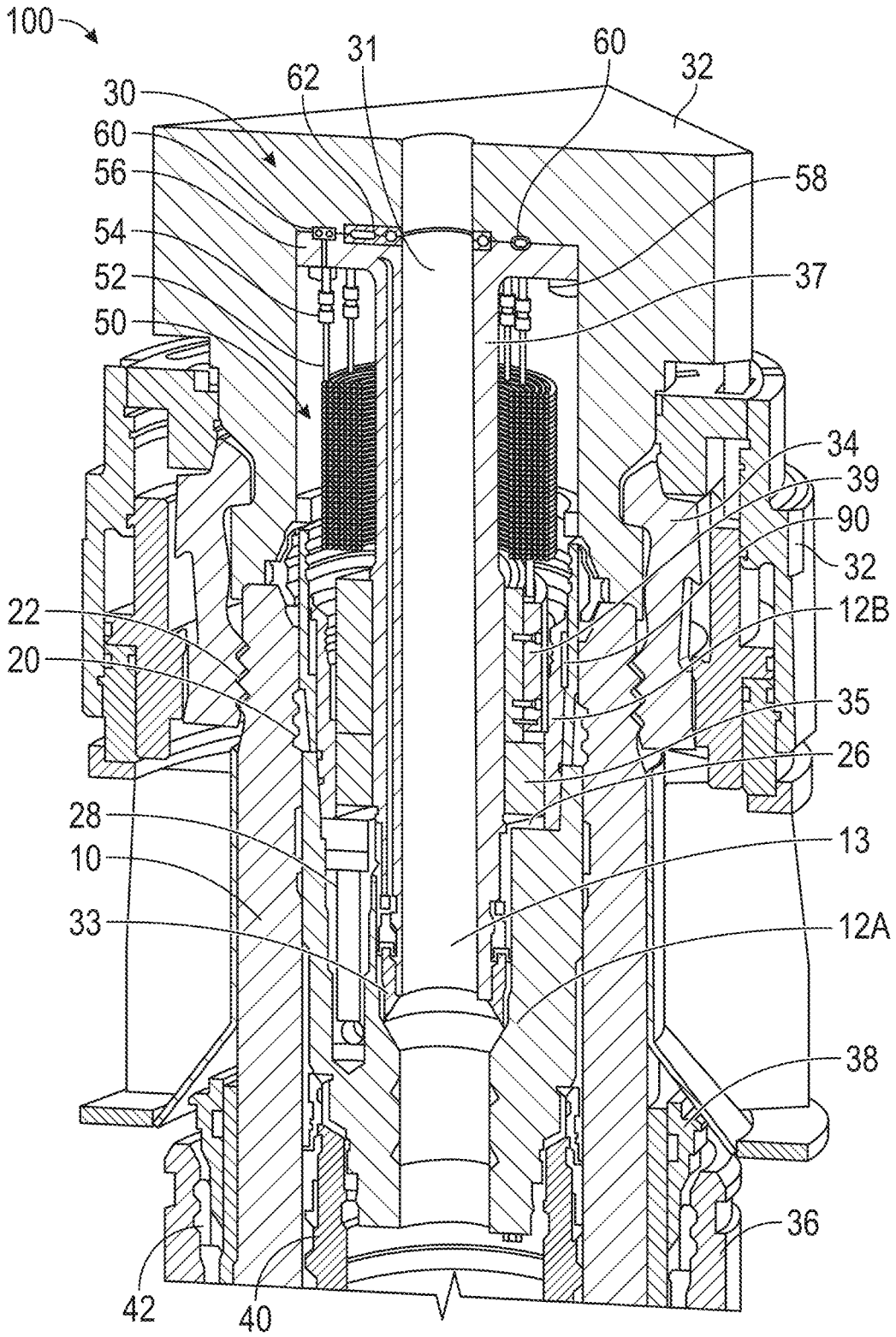

With the relative orientation between the stab body 37 and the coupler body 35 now fixed (subject to overcoming the biasing spring-force as described above) and established at the surface, and after removal of the BOP (if not done previously), the combination of the production tree/RIC assembly 30 is lowered toward the wellhead 10. FIG. 12 depicts the well at a point in time where the production bore sealing assembly 33 portion of the RIC assembly 30 is just about to be introduced into the well. FIG. 14 depicts the well wherein the RIC assembly 30 has only been partially inserted within the well. FIG. 15 depicts the well after the RIC assembly 30 has been fully installed in the well, similar to the situation depicted in FIG. 6. Between the views shown in FIGS. 14 and 15, the combination of the production tree/RIC assembly 30 is lowered into the well until such time as the orientation key 80 initially engages one of the angled guide surfaces 16 of the guide structure 11. At that point, continued lowering of the combination of the production tree/RIC assembly 30 generates a sufficient rotational torque of the coupler body 35 to overcome the biasing spring-force applied by spring 96, thereby allowing the coupler body 35 to rotate or ratchet around the stab body 37. The rotational force generated on the coupler body 35 is due to the relatively large weight of the combination of the production tree/RIC assembly 30 and the interaction between the orientation key 80 and one of the tapered angled guide surfaces 16 of the guide structure 11. The rotation of the coupler body 35 continues until such time as the orientation key 80 lands in or registers with the orientation slot 18, thereby properly orienting the production tree (or any particular outlet of the tree) relative to another structure or some reference grid, and vertically aligning the hydraulic coupling elements 70/26. At that point, the combination of the tree 32/RIC assembly 30 is further lowered to operatively couple the hydraulic coupling elements 70/26 to one another. In this embodiment, as before, the production tree/RIC assembly 30 does not rotate to any appreciable degree as the hydraulic components 26/70 are operatively coupled to one another. In this example, the biasing force of the spring 96 is sufficient to resist all anticipated rotational forces on the coupler body 35 during the installation process up to the point where the orientation key 80 lands on one of the angled guide surfaces 16.

As will be appreciated by those skilled in the art after a complete reading of the present application, there are several variations to the particular arrangement of various components described herein. For example, in the depicted embodiments, the orientation key 80 is positioned on the coupler body 35 and the orientation slot 18 is positioned in the tubing hanger 12. However, in some embodiments, the reverse may be true, i.e., the orientation key 80 may be positioned on the tubing hanger 12 and the orientation slot 18 may positioned in on the outer surface of the coupler body 35. Similarly, the guide structure 11 may be formed on the outer surface of the coupler body 35 instead of the inner surface of the tubing hanger 12. In this latter example, the intersection 15 between the angled guide surfaces 16 would be pointed downward instead of upward as shown in the depicted examples. Additionally, in some embodiments, the guide structure 11 with the angled guide surfaces 16 may be omitted entirely. For example, the orientation slot 18 may be provide with a relatively large "Y" type opening with outwardly tapered surfaces at the entrance to the orientation slot 18, whereby the outwardly tapered surfaces of the opening are adapted to interact with the orientation key 80 to direct the orientation key 80 into the narrower orientation portion of the orientation slot 18. In this example, assuming the orientation key 80 is attached to the coupler body 35, the RIC assembly 30 may be lowered into the well until such time as the orientation key 80 engages a horizontal landing surface. At that time, the production tree/RIC assembly 30 may be rotated until such time as the orientation key 80 engages one of the tapered surfaces of the opening of the orientation slot 18. At that point, the RIC assembly 30 may be lowered to its final vertical position, thereby operatively coupling the hydraulic components 26/70 to one another.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

What is claimed:

1. An apparatus, comprising:

a stab body;

first and second inlets/outlets;

a flange on an end of the stab body, wherein the first and second inlets/outlets are positioned adjacent an upper surface of the flange;

a coupler body positioned around the stab body, the coupler body adapted to rotate relative to the stab body;

first and second hydraulic coupling elements positioned on the coupler body;

first and second separate coiled tubes positioned around the stab body;

a first pressure-tight conduit that comprises the first inlet/outlet, the first coiled tube and the first hydraulic coupling element;

a second pressure-tight conduit that comprises the second inlet/outlet, the second coiled tube and the second hydraulic coupling element, wherein the first pressure-tight conduit is isolated from the second pressure-tight conduit;

a tubing hanger;

first and second hydraulic coupling elements positioned on the tubing hanger, wherein the first and second hydraulic coupling elements are, respectively, operatively coupled to the first and second hydraulic coupling elements;

a first orientation structure positioned on one of the coupler body or the tubing hanger; and a second orientation structure positioned on the other of the coupler body or the tubing hanger, wherein the second orientation structure and the first orientation structure are adapted to engage one another so as to establish a desired relative orientation between the coupler body and the tubing hanger.

2. The apparatus of claim 1, wherein the first orientation structure comprises an orientation slot and the second orientation structure comprises an orientation key.

3. The apparatus of claim 2, wherein the orientation slot is formed in the tubing hanger and the orientation key is positioned on the coupler body, and wherein the apparatus further comprises at least one angled surface formed on an interior surface of the tubing hanger, wherein the orientation slot is positioned adjacent an end of the at least one angled surface, and wherein the orientation key is adapted to engage the at least one angled surface.

4. The apparatus of claim 1, wherein the tubing hanger comprises:

a lower tubing hanger body; and an upper tubing hanger body, wherein the first and second hydraulic coupling elements positioned in the tubing hanger are positioned on the lower tubing hanger body, and wherein the upper tubing hanger body is coupled to the lower tubing hanger body by a threaded connection.

5. The apparatus of claim 1, further comprising:

at least one first anti-rotation feature positioned on an outer surface of the stab body; and at least one anti-rotation structure positioned on the coupler body, the at least one anti-rotation structure comprising at least one second antirotation feature, wherein the at least one second anti-rotation feature is adapted to be urged into engagement with the at least one first anti-rotation feature.

6. The apparatus of claim 1, wherein the coupler body is adapted to rotate around the stab body in a first direction for at most about 180° and adapted to rotate around the stab body in a second direction for at most about 180°, wherein the second direction is opposite to the first direction.

7. A method, comprising:

attaching at least one hydraulic coupling element to a tubing hanger;

securing the tubing hanger within a subsea well;

operatively coupling an apparatus to a bottom of a subsea production tree, the apparatus comprising:

a stab body;

at least one inlet/outlet;

a flange on an end of the stab body, wherein the first and second inlets/outlets are positioned adjacent an upper surface of the flange;

a coupler body positioned around the stab body, the coupler body adapted to rotate relative to the stab body;

at least one hydraulic coupling element positioned on the coupler body; and at least one coiled tube positioned around the stab body, the at least one coiled tube being in fluid communication with the at least one hydraulic coupling element and the at least one inlet/outlet;

lowering at least the production tree and the attached apparatus toward the subsea well until an orientation key engages at least one angled surface, the production tree and the attached apparatus having a combined weight;

continue lowering at least the production tree and the attached apparatus so as to further insert the apparatus into the subsea well, whereby the combined weight of at least the production tree and the attached apparatus forces the orientation key to travel along at least a portion of the at least one angled surface and causes the coupler body to rotate relative to the stab body;

continue lowering at least the production tree and the attached apparatus so as to further cause the coupler body to rotate until the orientation key registers in the orientation slot thereby vertically aligning the at least one hydraulic coupling element positioned on the coupler body with the at least one hydraulic coupling element on the tubing hanger; and continue lowering at least the production tree and the attached apparatus so as to cause the at least one hydraulic coupling element positioned on the coupler body and the at least one hydraulic coupling element on the tubing hanger to operatively engage one another.

8. The method of claim 7, further comprising securing the subsea production tree to a wellhead of the subsea well.

9. The method of claim 7, wherein the at least one angled surface is formed in an interior surface of the tubing hanger, the orientation slot is formed in the tubing hanger, the orientation slot is positioned adjacent an end of the at least one angled surface and the orientation key is positioned on the coupler body, wherein the orientation key is adapted to engage the at least one angled surface and register in the orientation slot.

10. The method of claim 7, wherein the tubing hanger comprises a lower tubing hanger body and an upper tubing hanger body that are coupled to one another by a threaded connection, and wherein, prior to securing the tubing hanger in the subsea well, the method comprises:

attaching the at least one hydraulic coupling element to the lower tubing hanger body; and rotating the upper tubing hanger body so as to threadingly couple the upper tubing hanger body to the lower tubing hanger body and position the orientation slot in the upper tubing hanger body in a desired orientation.

11. A method, comprising:

attaching at least one hydraulic coupling element to a tubing hanger;

installing the tubing hanger in its final installed position within a subsea well, the tubing hanger comprising a first orientation structure;

determining an as-installed orientation of the first orientation structure with respect to a second orientation structure;

positioning an apparatus at a surface location, the apparatus comprising:

a stab body;

at least one inlet/outlet;

a flange on an end of the stab body, wherein the first and second inlets/outlets are positioned adjacent an upper surface of the flange;

a coupler body positioned around the stab body, the coupler body adapted to rotate relative to the stab body;

at least one hydraulic coupling element positioned on the coupler body;

at least one coiled tube positioned around the stab body, the at least one coiled tube being in fluid communication with the at least one hydraulic coupling element and the at least one inlet/outlet; and the second orientation structure located on the coupler body, wherein the second orientation structure and the first orientation structure are adapted to engage one another so as to establish a desired relative orientation between the coupler body and the tubing hanger;

coupling the apparatus to a production tree;

with the apparatus positioned at a surface location and coupled to the production tree, rotating the coupler body around the stab body until such time as the second orientation structure is at a desired orientation, whereby, when the second orientation structure is in a final registered position with respect to the first orientation structure, the at least one hydraulic coupling element positioned on the coupler body will be operatively coupled to the at least one hydraulic coupling element on the tubing hanger; and lowering at least the production tree and the attached apparatus until the second orientation structure on the apparatus is positioned in its final registered position with respect to the first orientation structure and the at least one hydraulic coupling element is operatively coupled to the at least one hydraulic coupling element on the tubing hanger.

12. The method of claim 11, wherein the apparatus further comprises means for retarding relative rotation between the coupler body and the stab body, wherein the method further comprises, after rotating the coupler body around the stab body until the second orientation structure is at its desired orientation, stopping further rotation of the coupler body and allowing the means for retarding relative rotation between the coupler body and the stab body to become engaged, thereby retarding further rotation between the coupler body and the stab body.

13. The method of claim 12, wherein the means for retarding relative rotation between the coupler body and the stab body comprises:

at least one first anti-rotation feature positioned on an outer surface of the stab body; and at least one anti-rotation structure positioned in the coupler body, the at least one anti-rotation structure comprising at least one second anti-rotation feature, wherein the at least one second anti-rotation feature is adapted to be urged into engagement with the at least one first anti-rotation feature so as to thereby retard rotation between the coupler body and the stab body.

14. The method of claim 12, wherein the tubing hanger comprises a lower tubing hanger body and an upper tubing hanger body that are coupled to one another by a threaded connection, wherein a guide structure is formed in an interior surface of the upper tubing hanger body, and wherein the step of attaching the at least one hydraulic coupling element to the tubing hanger comprises attaching the at least one hydraulic coupling element to the lower tubing hanger body.

15. The method of claim 14, further comprising rotating the upper tubing hanger body to threadingly couple the upper tubing hanger body to the lower tubing hanger body.

* * * * *